US005566757A

United States Patent [19]

Carpenter et al.

[11] Patent Number: 5,566,757

[45] Date of Patent: Oct. 22, 1996

[54] METHOD AND APPARATUS FOR SETTING SIDETRACK PLUGS IN OPEN OR CASED WELL BORES

[75] Inventors: Robert B. Carpenter, Allen, Tex.; Anthony M. Badalamenti, Lafayette, La.; Jerry L. Logan, Katy, Tex.; David F. Laurel, Duncan, Okla.

[73] Assignee: Halliburton Company, Duncan, Okla.

[21] Appl. No.: 409,379

[22] Filed: Mar. 23, 1995

[51] Int. Cl.[6] ..... E21B 33/134

[52] U.S. Cl. ..... 166/285; 166/117.5; 166/177.4; 166/187

[58] Field of Search ..... 166/285, 313, 166/380, 387, 50, 117.5, 187, 153, 177.4; 175/49

[56] References Cited

U.S. PATENT DOCUMENTS 4,787,446 11/1988 Howell et al. ..... 166/187 X
4,913,229 4/1990 Hearn ..... 166/156
5,193,620 3/1993 Braddick ..... 166/382
5,195,591 3/1993 Blount et al. ..... 166/117.5
5,325,924 7/1994 Bangert et al. ..... 166/313

*Primary Examiner*—William P. Neuder
*Attorney, Agent, or Firm*—Craig W. Roddy; Anthony L. Rahhal

[57] ABSTRACT

A method and apparatus for use in setting sidetrack plugs in a well bore. The apparatus comprises an inflation packer assembly which may be attached to the lower end of the tubing string. The packer is inflated to seal against the well bore at the lower end of the sidetrack plug. The inflation packer is attached to a tubing string with a length of tail pipe. The tail pipe is releasably attached to the tubing string. After the inflation packer is sealed against the well bore, a cementitious fluid is circulated above the bladder to form the sidetrack plug. The tailpipe is then released and the tail pipe and the inflation packer remain in the hole and form a part of the sidetrack plug. An additional embodiment includes a whipstock connected to the inflation packer assembly.

37 Claims, 7 Drawing Sheets

METHOD AND APPARATUS FOR SETTING SIDETRACK PLUGS IN OPEN OR CASED WELL BORES

BACKGROUND OF THE INVENTION

The present invention relates generally to a method and apparatus for setting a sidetrack plug in a well bore. More particularly but not by way of limitation, the invention relates to a bottom hole tool which utilizes an inflation packer to set hydrostatically balanced or unbalanced kickoff plugs for altering the direction of a well bore.

During the drilling of a well, it is often necessary, for various reasons, to alter the direction of the well bore. One way to alter the well direction is to set a whipstock in a well bore. A whipstock has an inclined ramp or guide surface at its upper end. The whipstock may be placed in the well on top of a packer, and the direction of the well may be altered by directing a drill bit into the side of a well bore with the inclined ramp.

It is also well known that a column of cementitious fluid placed in a well bore is useful as a sidetrack or kickoff plug for altering the direction of the well bore as it is being drilled. Such plugs may be either hydrostatically balanced or unbalanced. Once the sidetrack plug is set in the well bore, a drill bit can drill into the plug and into the side of the well bore to alter the direction of the well bore. There are however, difficulties associated with setting such plugs.

Sidetrack plugs are presently set by lowering an open ended tubing string into a well bore to the desired depth of the plug. A cementitious fluid is pumped through the tubing string and out the open end of the tubing string. The pressure in the well bore forces the cementitious fluid up the annulus between the tubing string and the well bore. The cementitious fluid is continually displaced until a kickoff plug of a desired length is set. The tubing is then removed from the hole and the cementitious fluid is allowed to gel and harden. As the tubing is pulled from the cementitious fluid, however, a vacuum or suction is created in the fluid which can often contaminate the kickoff plug by drawing debris from the well bore into the cementitious fluid. Such contamination affects the integrity of the plug. Thus, such a method often does not allow successful sidetrack drilling to begin on the first attempt. The industry range for obtaining a successful sidetrack using such a plug is 2 to 4 attempts.

SUMMARY OF THE INVENTION

The present invention provides a bottom hole tool assembly and a method for setting sidetrack or "kickoff" plugs which allow for a successful sidetrack with one attempt. The assembly includes a tail pipe with a central or tail pipe bore therethrough releaseably attached to a conventional tubing string which may be, but which is not limited to a string of drill pipe, and an inflation packer assembly attached to the tail pipe. The invention includes a releasing means to release the tail pipe from the tubing string. Thus, the tail pipe and the inflation packer assembly are left in the hole after the sidetrack plug is set, and the tail pipe forms a part of the plug.

The inflation packer assembly includes a substantially cylindrical packer mandrel with a central flow passage defined therethrough, and a substantially cylindrical packer body disposed about the packer mandrel. The central flow passage is communicated with the tail pipe bore. The packer body includes an inflatable packer bladder. The inflation packer also includes an inflation passage means for communicating inflation fluid to the packer bladder and a circulation or communications means for communicating the central flow passage with the well bore. The circulation means is operably associated with the packer bladder so that the central flow passage is communicated with the well bore only after the packer bladder reaches a desired or maximum inflation pressure.

The circulation means includes an inflation port defined in the packer mandrel and a circulation port defined in the packer body which communicates with the inflation port. The inflation port is communicated with the central flow passage. The inflation passage means includes the inflation port defined in the packer mandrel and a longitudinally extending annular inflation fluid passageway defined between the packer body and the packer mandrel. The central flow passage is therefore communicated with the annular passageway through the inflation port.

The bottom hole tool also includes a inflation port opening sleeve which is disposed in the packer mandrel. The opening sleeve is releaseably attached to the packer mandrel and is initially located in the mandrel to prevent flow through the inflation port. The sleeve is adapted to release from the mandrel thereby opening the inflation port and communicating the port with the annular passageway.

One embodiment of the apparatus includes a whipstock with a whipstock mandrel attached thereto. The whipstock mandrel includes a first end which is releaseably attached to the tubing string and a second end attached to the tail pipe. The whipstock mandrel has a central bore or whipstock bore defined therethrough, which is in communication with the central flow passage.

A check valve disposed in the annular inflation fluid passageway divides the passageway into an upper portion and a lower portion, and allows fluid to flow only from the upper portion to the lower portion. The inflatable packer bladder is disposed about the lower portion of the annular passageway.

The method of the present invention generally includes attaching a tail pipe and an inflation packer assembly which includes an inflatable packer bladder to a tubing string and lowering the tubing string into a well bore. The method further comprises circulating fluid through the tubing string and the packer assembly to a fluid diverter attached to the lower end thereof as the tool is lowered into the well bore. The fluid is circulated into the well bore from the desired top of the kickoff plug downward and removes gelled mud and other debris from the well bore thus providing for improved cementation. The method further includes inflating the packer bladder to seal against a well bore after the packer assembly reaches the desired lower end of the kickoff plug. After the packer bladder is inflated, the method comprises displacing a cementitious or settable fluid into the well bore above the packer bladder to form the sidetrack plug, and releasing the tail pipe from the tubing string after the plug is in place. The cementitious fluid is displaced into the well bore by communicating a central flow passage of the inflation packer assembly with the well bore after the packer is inflated, and pumping a cementitious fluid through the central bore of the tail pipe, into the central flow passage and into the well bore.

The pumping step is continued until the cementitious fluid reaches an upper end of the tail pipe. The tubing string is then released from the tail pipe, so that the tail pipe and inflation packer remain in the well bore, and the tail pipe forms a part of the sidetrack plug. In the alternative embodiment, which includes a whipstock having a whipstock mandrel with a central bore therethrough, the cementitious fluid is pumped through the bore of the whipstock mandrel into the tail pipe bore and central flow passage, and then into the well bore until it reaches an upper end of the whipstock mandrel. The tubing string is thereafter released from the whipstock so that the whipstock remains in the hole and forms a part of the kickoff plug.

Accordingly, it is an object of the present invention to provide a new method and apparatus for setting a sidetrack plug which will allow successful sidetrack drilling with one attempt. It is another object to provide a new and improved method and apparatus for setting a sidetrack plug utilizing an inflation packer and a tail pipe which can be released from a string of tubing after the sidetrack plug is set.

DETAILED DESCRIPTION OF THE PREFERRED EMBODIMENTS

Figure 3:
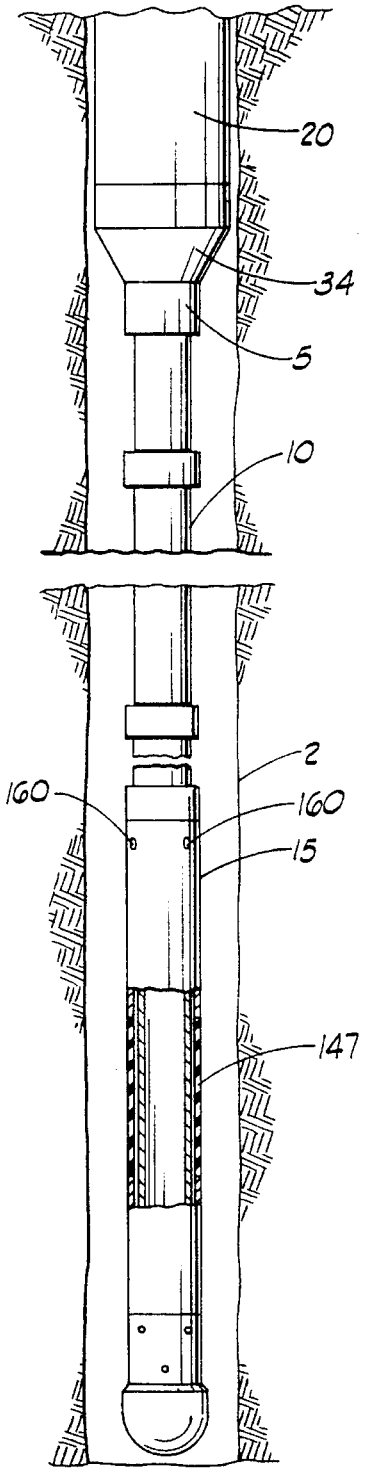
FIG. 3 shows a schematic of the present invention lowered into a well bore.
Figure 4:
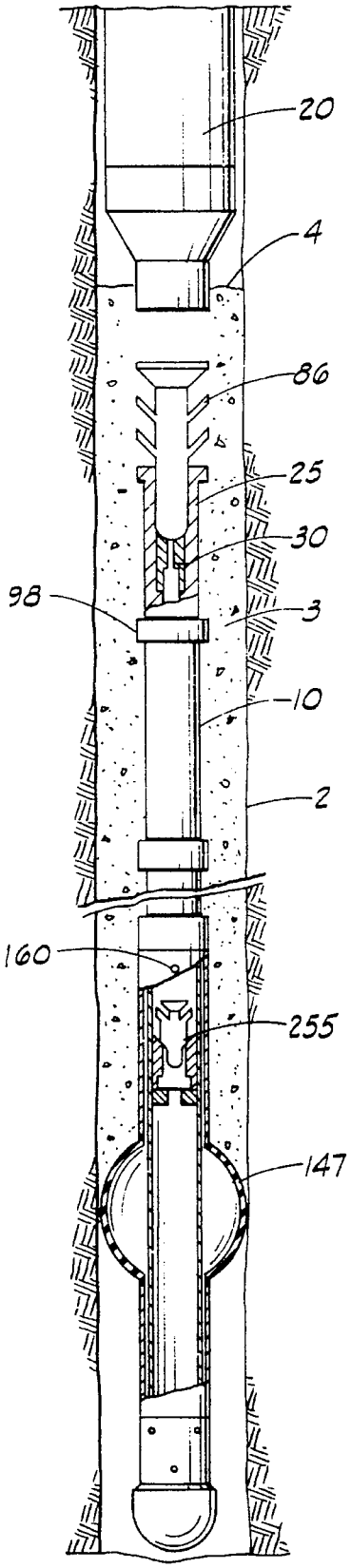
FIG. 4 shows a schematic of the invention after the kickoff plug is in place.

A bottom hole tool apparatus for setting sidetrack or kickoff plugs in a well bore is shown in FIGS. 1A–1F, and is generally designated by the numeral 1. The tool includes a release mechanism 5, a length of tailpipe 10 and an inflation packer assembly 15. The release mechanism is adapted to be connected to a tubing string 20 thereabove which may be a string of drill pipe or other string of pipe known in the art. The tool is shown in FIG. 3 attached to the tubing string lowered into a well bore 2. The tool can be utilized in either open or cased well bores. FIG. 4 shows a schematic after a sidetrack plug 3 has been set in well bore 2. The top of the sidetrack plug is generally designated by the numeral 4.

Release mechanism 5, which may also be referred to as a releasing means 5 includes a collet 25, a releasing sleeve 30 and a collet retainer 32. Collet retainer 32 is adapted to be connected to the tubing string 20 with an adapter 34. Collet retainer 32 is connected to adapter 34 at threaded connection 36 with a seal provided therebetween by O ring seal 38. The adapter 34 is connected to the tubing string 20 at threaded connection 40.

Collet retainer 32 includes a first inner surface 42, a second inner surface 44 and an upward facing shoulder 46. Second inner 44 includes a slotted groove 48. A grease port 41 having a threaded screw 43 received therein is defined through the collet retainer.

Figure 7:
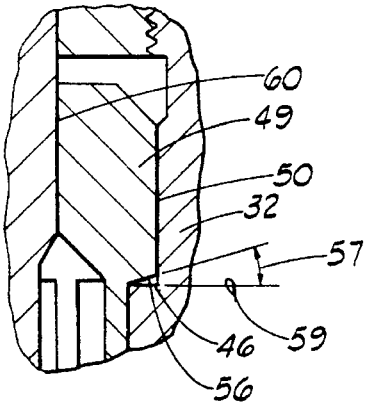

Collet 25 has a plurality of angularly spaced collet fingers 49 and includes a first outer surface 50 and a second outer surface 52. First outer surface 50 is closely received in first inner surface 42 of the collet retainer, and second outer surface 52 is closely received in second inner surface 44 of the collet retainer. A seal is provided between collet 25 and collet retainer 32 by a slotted wiper rod 54 disposed in slotted groove 48. Collet 25 further includes a downward facing shoulder 56 which engages upward facing shoulder 46 of the collet retainer. Downward facing shoulder 56 is tapered upward slightly, so that an angle 57 exists between downward facing shoulder 56 and a substantially horizontal line 59. Angle 57, as better shown in FIG. 7, is preferably 0° to 45° and more preferably approximately 15°.

Releasing sleeve 58, has first, second and third outer surfaces 60, 62 and 64 respectively. First outer surface 60 engages an inner surface 66 of drill pipe adapter 34 and has a seal provided therebetween by O ring seal 68. The O ring seal is received in a groove 70 disposed in the drill pipe adapter. First outer surface 60 also engages an inner surface 72 of collet fingers 49. The releasing sleeve keeps collet 25 in an open position so that downward facing shoulder 56 of the collet 25 and upward facing shoulder 46 of collet retainer 32 are engaged, thereby retaining the collet 25 within the collet retainer 32.

Third outer surface 64 of the releasing sleeve engages an inner surface 74 of collet 25 with a seal provided therebetween by an O ring seal 76. The releasing sleeve 30 is releasably attached to collet 25 with a plurality of shear pins 78 which extend through collet 25 and into a plurality of apertures 79 defined through the releasing sleeve. Releasing sleeve 25 further includes an upward facing ball seat 80, a first sleeve bore 82 and a second sleeve bore 84. Ball seat 80 is adapted to receive a releasing ball or dart 86 dropped through tubing string 20. The ball or plug can be of any type known in the art, and is schematically shown in FIG. 4.

After releasing dart 86 is received in ball seat 80, pressure is increased in the tubing string thereabove, until it reaches a predetermined shear strength of shear pins 78. Shear pins 78 then break off allowing the releasing sleeve to fall downward within collet 25. Collet 25 includes an upward facing shoulder 88 which engages a lower end 90 of the releasing sleeve thereby stopping the downward movement of the sleeve after it is detached from collet 25. Once the releasing sleeve detaches, collet fingers 49 will flex or move radially inwardly, and tapered upward facing shoulder 56 will disengage from upward facing shoulder 46, thereby releasing collet 25 from the collet retainer. The tubing string can then be removed, while the collet and anything therebelow remain in well bore 2. FIG. 4 shows a schematic of the present invention after kickoff plug 3 has set and the tubing string 20 is released from the tail pipe 10.

Release mechanism 5 is connected at threaded connection 96 to an adaptor 98. Adaptor 98 is connected to tail pipe 10 at threaded connection 100. The tail pipe 10 generally consists of a plurality of nipples 104 connected in series by a plurality of couplings 102. The tailpipe is to be constructed of a drillable material, such as, but not limited to, aluminum, composites, plastic or fiberglass. The tail pipe can be made up to be any desired length, preferably from 50 feet to 750 feet by increasing or decreasing the number of nipples used. The tail pipe 10 has a tail pipe bore 106 defined therethrough.

Figure 2A:
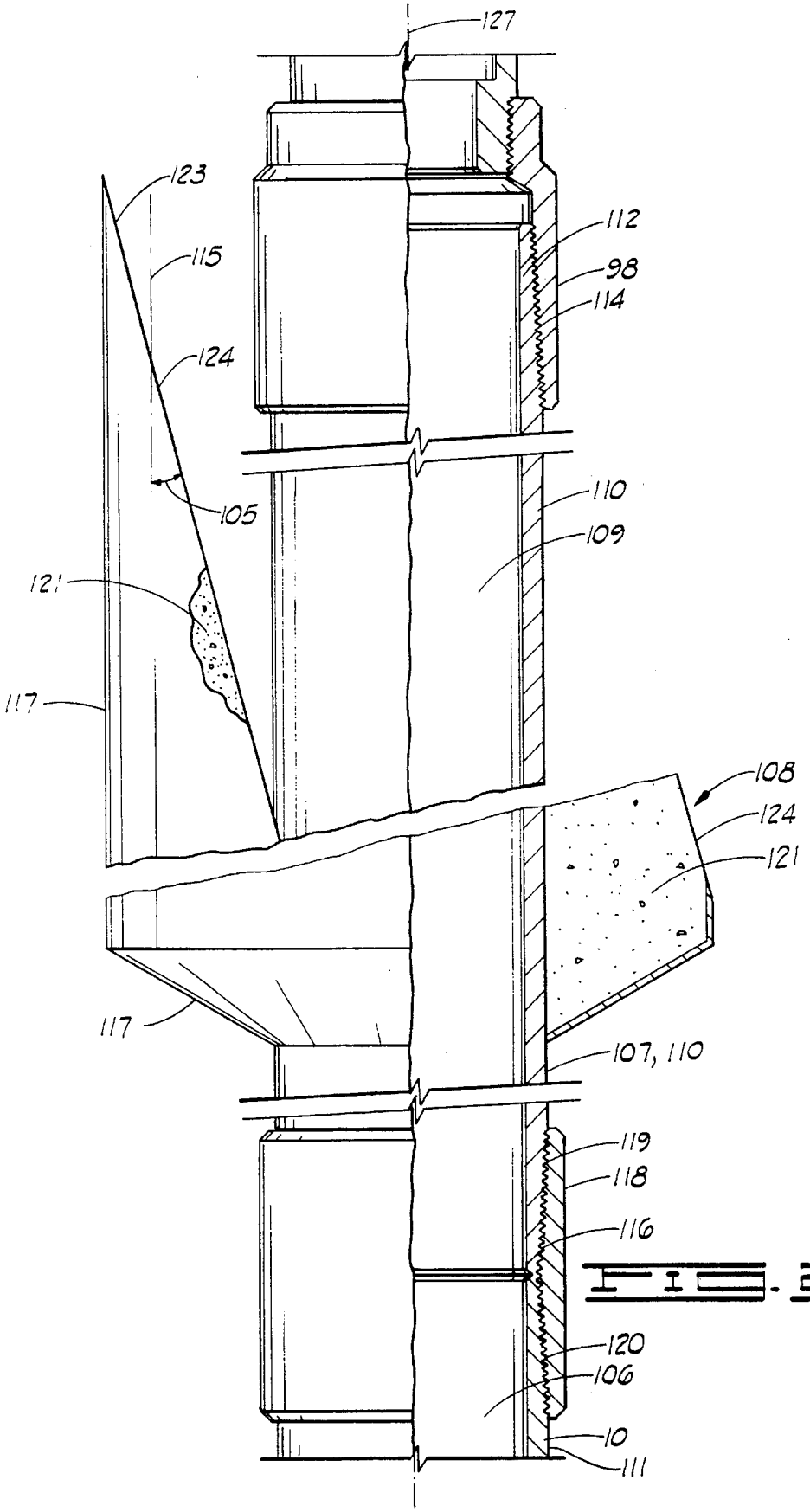
FIGS. 2A–2C show an alternative embodiment of the present invention.
Figure 2B:
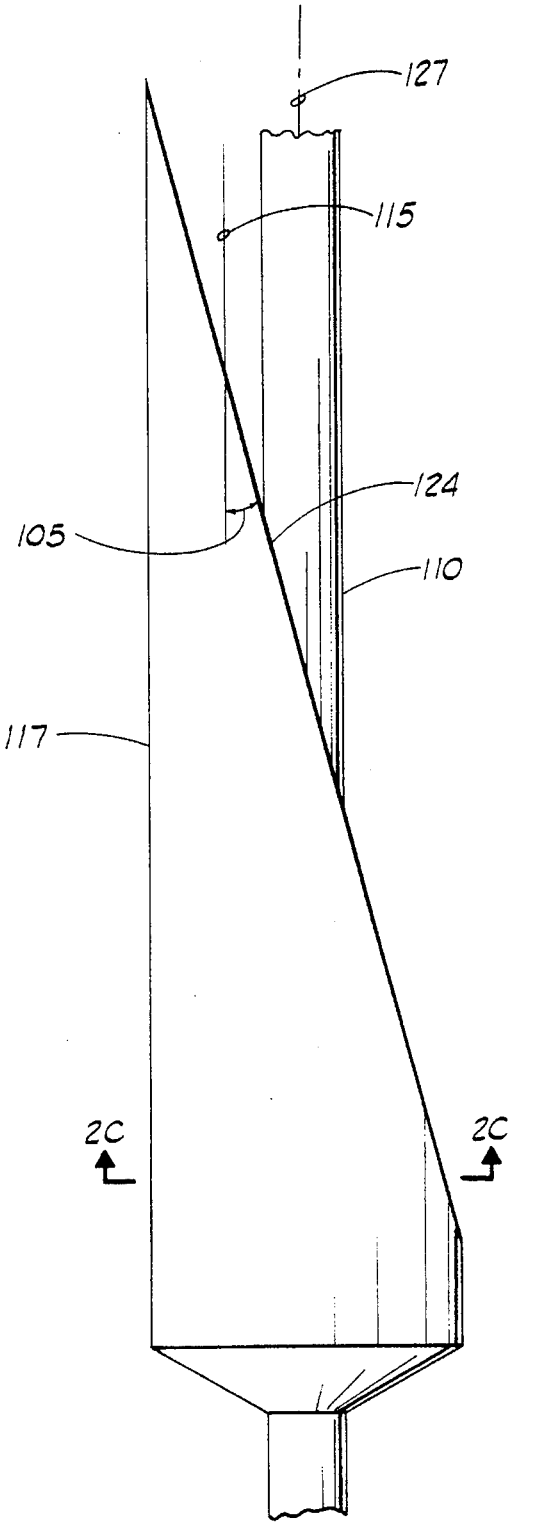
Figure 2C:
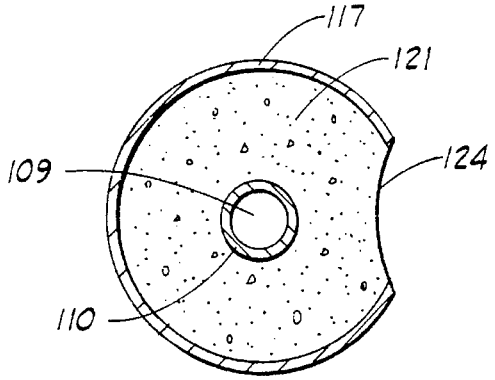

Another embodiment of the present invention, shown in FIGS. 2A–2C, includes a whipstock 108. Whipstock 108 includes a whipstock case 117 with a whipstock mandrel 110 attached thereto. The whipstock mandrel has a central or whipstock bore 109 defined therethrough and an outer diameter 107 which is substantially the same as an outer diameter 111 of tail pipe 10. Whipstock mandrel 110 may be connected at its upper end 112 to adapter 98 at threaded connection 114. Alternatively, whipstock mandrel 110 may be connected at its upper end 112 to a length of tail pipe 10, which is in turn connected to adaptor 98. Specifically, upper end 112 may be connected to a coupling 102, which is, as provided herein, connected to a nipple 104. Any length of tailpipe can be attached to the upper end of the whipstock mandrel so that the whipstock is at the desired depth in the well bore. The tailpipe is connected at its upper end to adapter 98.

Whipstock mandrel 110 is connected at a lower end 116 to a coupling 118 at threaded connection 119. Coupling 118 is connected to tail pipe 10 at threaded connection 120. Tailpipe 10 is, as explained more fully herein, connected to inflation packer assembly 15. The inflation packer assembly will anchor the whipstock in the well bore, and may thus be referred to as an anchoring means. Whipstock 108 further includes a whipstock body 121 having an upper end 123 disposed in whipstock case 117. Whipstock mandrel 110 extends through whipstock body 121. An inclined ramp 124 is defined at upper end 123 of whipstock body 121. Whipstock ramp 124 preferably, as shown better in FIG. 2C, has a concave surface. Whipstock 108, including whipstock mandrel 110, whipstock case 117, whipstock body 121 and ramp 124 is to be constructed of a drillable material. Whipstock case 117 and whipstock mandrel 110 may be comprised of drillable material, such as, but not limited to, aluminum, composites, plastic and fiberglass. Whipstock body 121 and ramp 124 are comprised of a drillable material which may be, but is not limited to, high compressive strength cement. Inclined ramp 124 is inclined at angle 105 from a substantially vertical line 115. Line 115 is parallel to a longitudinal central axis 127 of whipstock mandrel 110. Angle 105 is preferably 1° to 5° and is more preferably 1° to 3°. The angle depicted in the drawings is shown greater than the actual angle for purposes of clarity.

Figure 1A:
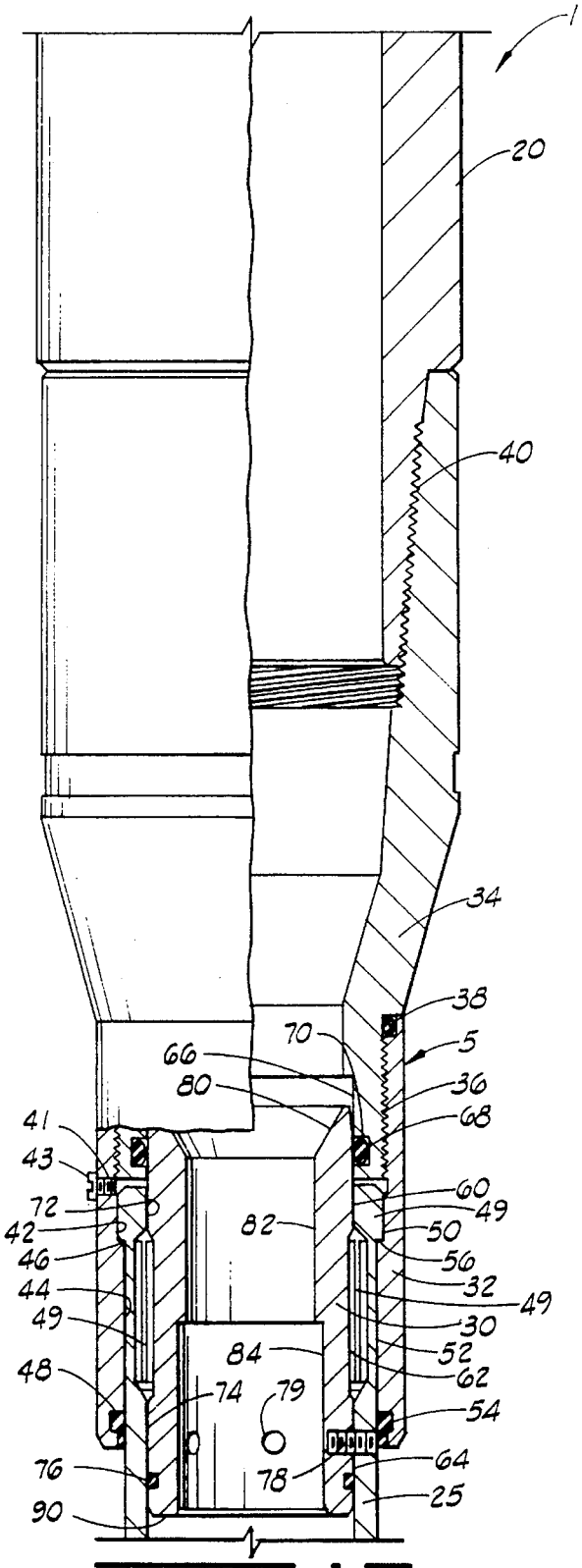
FIGS. 1A–1F comprise an elevation partially sectioned view of the present invention.
Figure 1B:
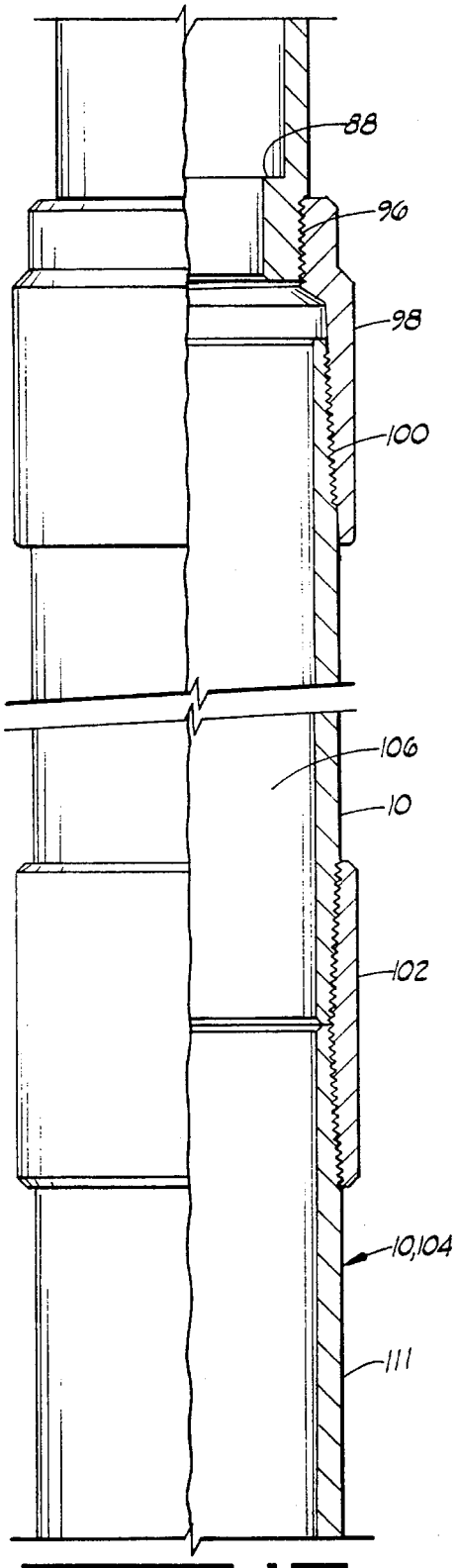
Figure 1C:
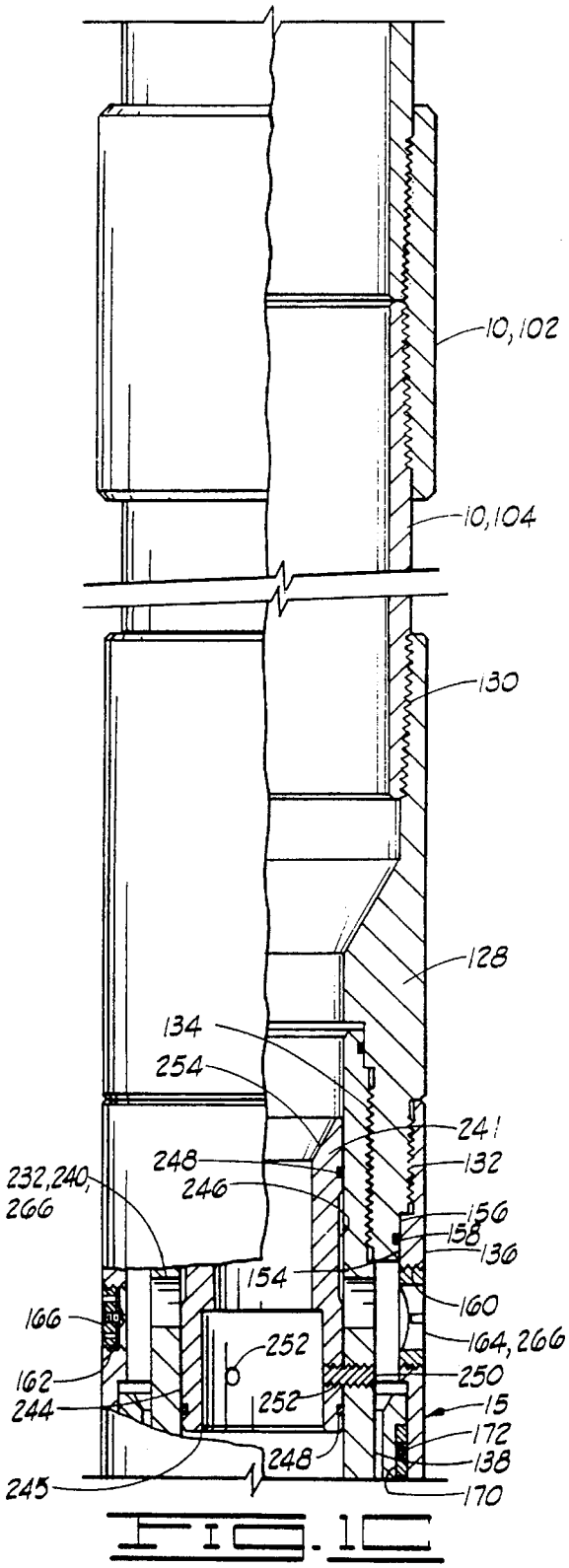
Figure 1D:
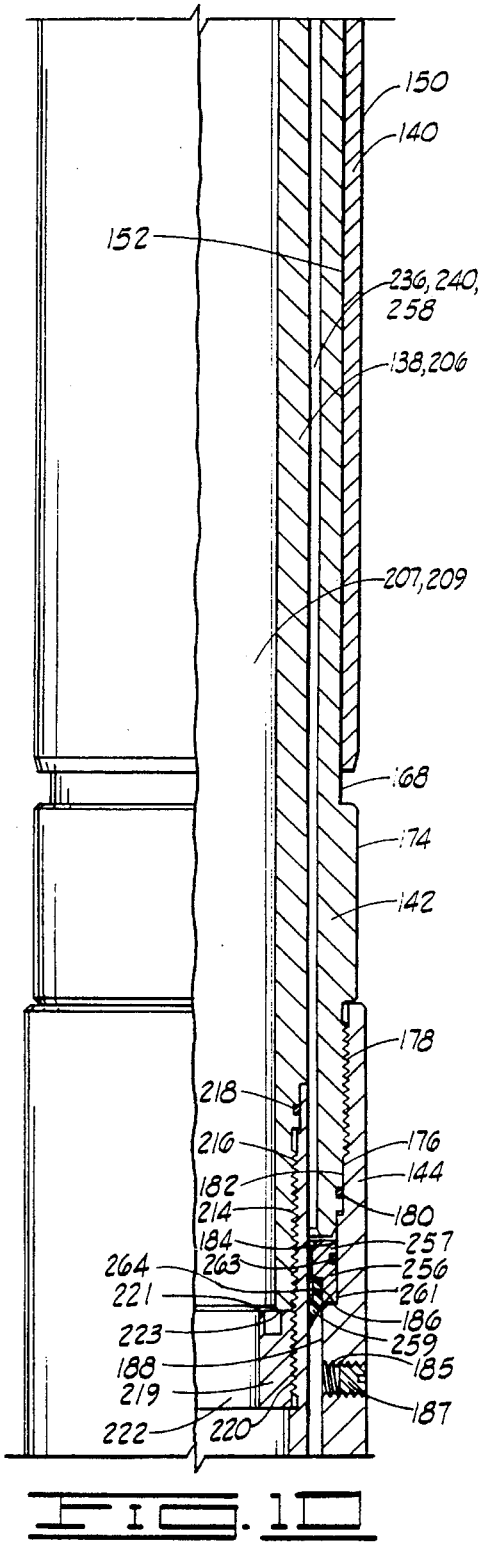
Figure 1E:
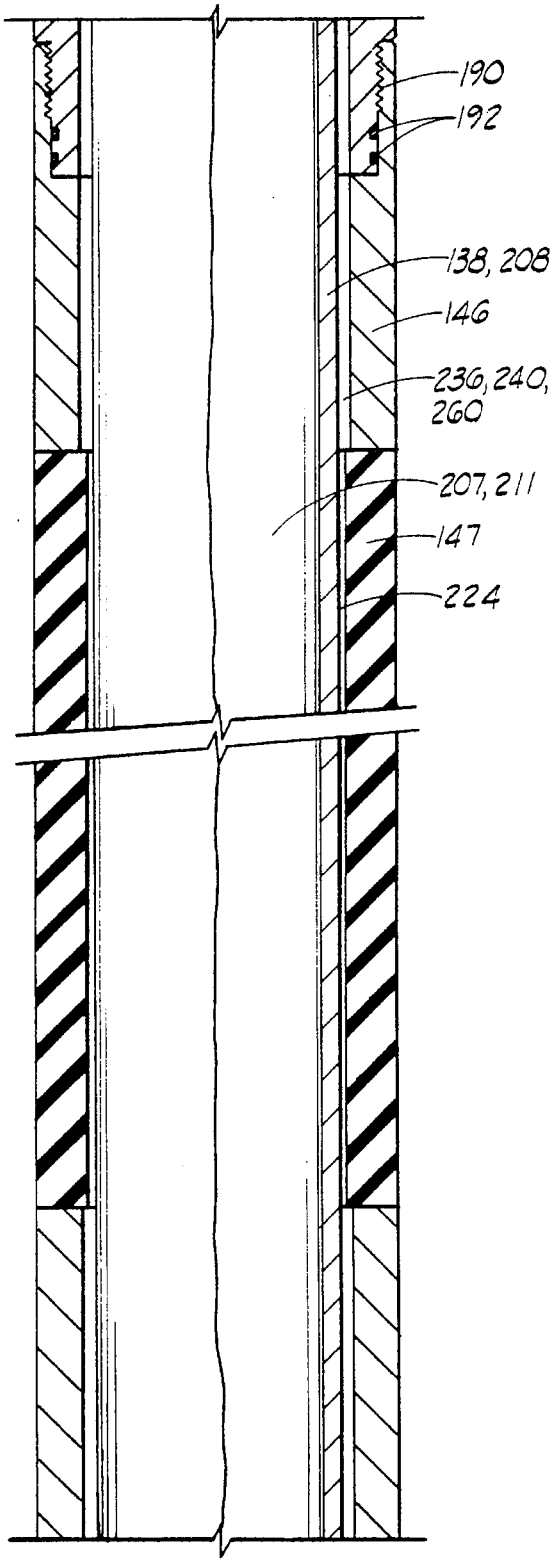

As shown in FIG. 1C, tailpipe 10 is connected at its lower end to a lift sub 128 at threaded connection 130. Lift sub 128 is connected to packer assembly 15 at threaded connections 132 and 134. Packer assembly 15 is to be constructed of drillable material and includes an outer packer body 136 which is connected to the lift sub at threaded connection 132 and a packer mandrel 138 which is connected to the lift sub at threaded connection 134.

Packer body assembly 136 includes an upper body extender 140, a lower packer body extender 142, an upper end ring 144, a packer element 146 which includes an inflatable packer bladder 147, and a lower end ring 148. Upper packer body extender 140 is connected to the lift sub at threaded connection 132. Upper body extender 140 includes an outer surface 150 and an inner surface 152, which includes an inwardly extending lug 154. Inwardly extending lug 154 engages an outer surface 156 of lift sub 128 with a seal provided therebetween by O ring seal 158. Inwardly extending lug 154 has a circulation port 160 and a valve port 162 defined therethrough. The upper body extender may include a plurality of circulation ports 160 as shown in FIG. 3. A rupture disc 164 is threadedly received in circulation port 160 and a pressure regulating valve 166 is threadedly received in valve port 162.

Lower body extender 142 includes a first outer surface 168 which is closely received in upper body extender 140. A seal is provided between the upper and lower body extenders with an O ring seal 172. The seal is disposed in a groove 170 defined on first outer surface 168 of lower body extender 142. Lower body extender 142 further includes a second outer surface 174 and a third outer surface 176. Lower body extender 142 is connected to upper end ring 144 at threaded connection 178 with a seal provided therebetween by O ring seal 180. O ring seal 180 provides a seal between third outer surface 176 of lower body extender 142, and a first inner surface 182 of upper end ring 144. Upper end ring 144 further includes a second inner surface 184, an upwardly facing shoulder 186 and third inner surface 188. A first or upper radial fluid relief port 185 is defined through end ring 144, and has a threaded plug 187 received therein. Upper end ring 144 and packer element 146 are connected at threaded connection 190 with a seal provided therebetween by O ring seals 192.

Packer element 146 and lower end ring 148 are connected at threaded connection 198 with a seal provided therebetween by O rings 200. Lower end ring 148 includes a first inner surface 202, upward facing shoulder 203 and a second inner surface 204. A second or lower radial fluid relief port 201 is defined through lower end ring 148, and has a threaded plug 205 received therein.

Packer mandrel 138 includes an upper mandrel 206 and a lower mandrel 208. Upper mandrel 206 and lower mandrel 208 include central bores 209 and 211 respectively. Central bores 209 and 211 may be referred to collectively as a central flow passage 207. Upper mandrel 206 is connected to lift sub 128 at threaded connection 134. Upper mandrel 206 is connected to an upper inner thread 214 of lower mandrel 208 at threaded connection 216. A seal is provided between upper mandrel 206 and lower mandrel 208 by O ring seal 218. A stop collar 219 is connected to threads 214 below a lower end 223 of upper mandrel 206 at threaded connection 220. Stop collar 219 includes an upper surface 221 and a central bore 222. Central bore 222 of stop collar 219 has a diameter smaller than central bore 209 of upper mandrel 206. Upper surface 221 therefore extends radially inwardly into central flow passage 207.

Lower mandrel 208 includes a first outer surface 224 and a second outer surface 226. Second outer surface 226 of the lower mandrel is closely received in second inner surface 204 of lower end ring 148. A seal is provided between lower mandrel 208 and end ring 148 by seal 234.

A longitudinally extending annular inflation fluid passageway 236 is defined between packer mandrel 138 and packer body 136. Upper mandrel 206 has an inflation port 232, and may include a plurality of inflation ports 232, radially defined therethrough which communicates central flow passage 207 with annular inflation fluid passageway 236 at an upper end thereof. Passageway 236 terminates at upward facing shoulder 203 of lower end ring 148. Pressure regulating valve 166 allows fluid to flow in a direction into annular inflation passageway 136 from well bore 2 but prevents flow in the opposite direction, thus equalizing pressure in the well bore and the passageway and preventing inflatable packer bladder from collapsing as the apparatus is lowered into the well bore. Inflation port 232 and annular inflation fluid passageway 236 may be referred to as an inflation passage means 240 for communicating inflation fluid to packer bladder 147.

The apparatus includes an inflation port opening sleeve 241, which is closely received in central bore 209 of upper mandrel 206 and which is positioned to block flow through inflation port 232. Inflation port opening sleeve 241 includes an outer surface 244, a recessed surface 246 and a lower end 245. A seal is provided between bore 209 of upper mandrel 206 and surface 244 by a plurality of O rings 248. Opening sleeve 241 is releaseably attached in bore 209 with shear pins 250 which extend radially through upper mandrel 206 into a plurality of apertures 252 defined through opening sleeve 241. Opening sleeve 241 further includes a plug or ball seat 254 defined on its upper surface for receiving an opening dart or opening ball 255. The opening dart 255 is dropped through the tubing string, release mechanism 5 and tail pipe bore 106 into central flow passage 207 until it is received in seat 254, blocking flow through the central passage 207. FIG. 4 shows a schematic of the invention with the opening dart seated and packer bladder 147 inflated. In the alternative embodiment shown in FIG. 2, the opening dart will also pass through bore 109 of whipstock mandrel 110.

Pressure is increased in the tubing string which causes shear pins 250 to break off, releasing opening sleeve 241 from upper mandrel 206. Opening sleeve falls through central flow passage 207 until the lower end 245 thereof engages upper surface 221 of stop collar 219, thereby blocking flow through central flow passage 207 and directing flow through inflation port 232 into annular inflation fluid passageway 236.

A check valve assembly 256 is disposed in annular inflation fluid passageway 236 dividing the passageway into an upper portion 258 and a lower portion 260. Check valve 256 includes a backup ring 257 with an elastomeric seal 259 attached thereto. Backup ring 257 has an outer surface 261 which is closely received in upper end ring 144, with a seal provided therebetween by O ring seal 263. Backup ring 257 further includes a lower surface 264 which abuts upward facing shoulder 186 of upper end ring 144. Check valve 256 allows fluid to flow only in a direction from upper portion 258 to lower portion 260 of the annular inflation fluid passageway. Packer bladder 147 is adjacent to and is disposed about lower portion 260 of the annular passageway. Inflation fluid therefore passes from central flow passage 207 through inflation port 232 and into the upper portion 258 of the annular inflation fluid passageway. Inflation fluid then passes into lower portion 260 of the passageway, thereby inflating packer bladder 147, so that it seals against the side of a well bore 2, as shown schematically in FIG. 4.

Rupture disk 164 is operably associated with packer bladder 147, so that it ruptures when the bladder reaches its maximum inflation pressure, thereby communicating the well bore with the central flow passage 207 through inflation port 232 and circulation port 160. Inflation port 232 and circulation port 160 may thus be referred to as a communication means or circulation means 266 for communicating fluid to the well bore from central flow passage 207. The circulation means 266 is operably associated with packer bladder so that, as described hereinabove, circulation port 160 is initially closed. Circulation port 160 opens and fluid is communicated to the well bore only after packer bladder 147 reaches its desired inflation pressure.

Once fluid communication is established between central flow passage 207 and well bore 2, a cementitious fluid is pumped through the tubing string into central bore 106 of tailpipe 10, central flow passage 207, through inflation port 232 and circulation port 160 and into the well bore. The cementitious fluid generally be displaced until the top 4 of plug 3 reaches the release mechanism 5. Thus, cementitious fluid is displaced until the top of the plug 3 is above the upper end of the tail pipe, as seen in FIG. 4. If the whipstock 108 shown in FIG. 2 is utilized, cementitious fluid may be displaced until the top of plug 3 is above the upper end of whipstock mandrel 110.

Figure 5:
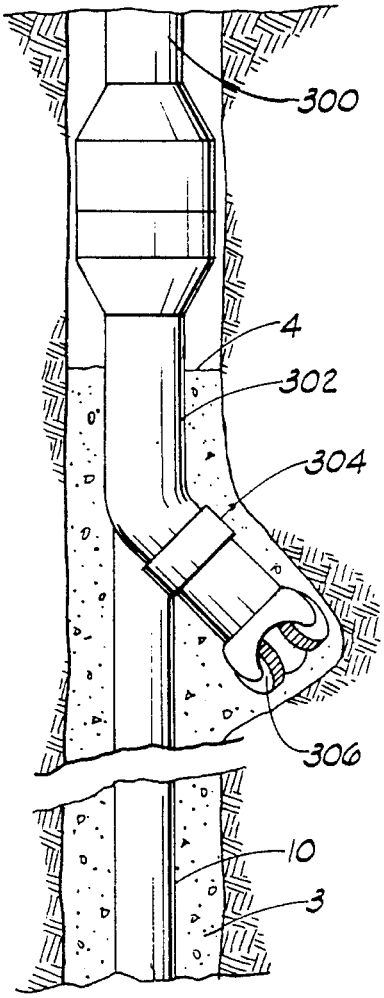
FIG. 5 shows the invention after the plug has been set and the tubing string removed and a drill string has been lowered into the well bore to begin sidetrack drilling operations.

Releasing dart 86 is then dropped through the tubing string until it is received in releasing sleeve 58. Pressure is increased until shear pins 78 break, thus releasing tubing string 20. Thus, the tail pipe, and in the alternative embodiment the whipstock, remains in the well bore and comprises a part of the sidetrack plug 3. Because the whipstock 108, tailpipe 10 and whipstock packer assembly 15 are to be constructed of drillable materials, the well bore 2 can be reopened, if desired, simply by drilling through the sidetrack plug. Because the tail pipe remains in the hole, no vacuum or suction is created when the tubing string is removed, and the risk of contaminating the plug is minimized. After the sidetrack plug is in place, a drill pipe 300 can be tripped into the well bore with a bent sub 302, a motor assembly 304 and a drill bit 306 as seen is FIGS. 5 and 6 and sidetrack drilling can begin.

Figure 1F:
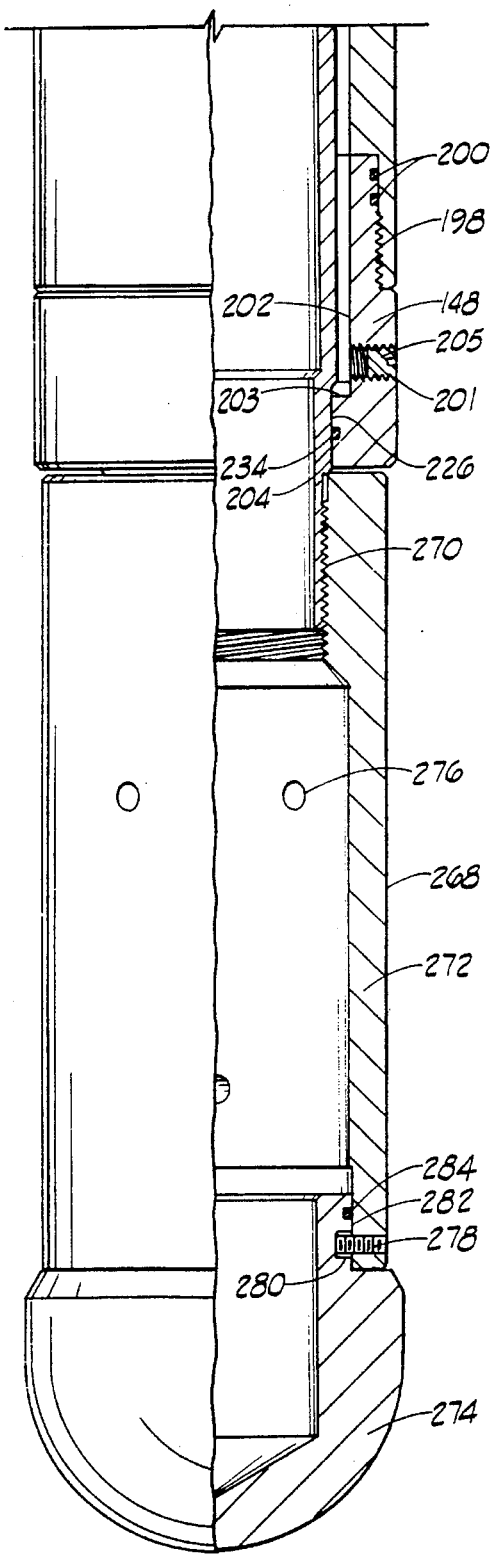

As seen in FIG. 1F, the lower mandrel 208 is connected to a fluid diverter assembly 268 at threaded connection 270. Fluid diverter assembly 268 includes a fluid diverter sub 272 and a guide nose 274. Fluid diverter sub 272 has a plurality of jetting apertures 276 defined therethrough. The jetting apertures will jet fluid circulated through the apparatus upwardly and tangentially as the apparatus is lowered into a well bore. The jetting action will assist in and provides a means for breaking gelled mud and other debris from the well bore, which provides for improved cementation. Guide nose 274 is releaseably attached to fluid diverter sub 272 with a shear pin 278 which extends through fluid diverter sub 272 and into a groove 280 defined in a first outer surface 282 of guide nose 274. First outer surface 282 is closely received in fluid diverter sub 272. A seal is provided between fluid diverter sub 272 and guide nose 274 by an O-ring seal 284.

METHOD OF OPERATION

Referring now to the drawings, the operation of the present invention is described as follows. The bottom hole tool assembly 1 is assembled into a string of tubing and the tubing is lowered into the well bore 2. Guide nose 274 will assist in lowering the apparatus into the well bore. As the tool is lowered into the well bore, fluid is circulated through the tubing string, through tail pipe bore 106, central flow passage 207 and into fluid diverter 268. Jetting apertures 276 will jet fluid out of the apparatus upwardly and tangentially as the tool is lowered into the well bore. The jetting action will assist in breaking up gelled mud from the side of the well bore for improved cementation. After the tool is lowered into the well, inflation fluid is communicated through the tubing string and tail pipe bore 106 into the inflation packer assembly where it inflates packer bladder 147. To inflate the packer bladder, an opening dart 255 is dropped through the tubing string. The plug passes through release mechanism 5 and tail pipe bore 106 and into central flow passage 207. The plug seats in ball seat 254 of inflation port opening sleeve 241. Opening sleeve 241 initially is releaseably attached to the upper mandrel 206 with shear pins 250 and is located to prevent communication between inflation port 232 and central flow passage 207. After opening dart 255 is seated, pressure is increased in the tubing string until shear pins 250 are sheared. The opening sleeve then slides through central bore 209 of upper mandrel 206 until the lower end of the opening sleeve engages stop collar 219. After the opening sleeve engages stop collar 219, flow through central flow passage 207 is completely obstructed. Fluid pumped into central flow passage 207 will therefore pass through inflation port 232 and into annular inflation fluid passageway 236. The annular inflation fluid passageway 236 is divided into an upper portion 258 and a lower portion 260 by check valve 256. Inflation fluid flows from central flow passage 207 through inflation port 232 into upper portion 258 of the annular inflation fluid passageway and then into the lower portion 260. Check valve 256 prevents flow from the lower portion 260 to the upper portion 258 of the annular inflation fluid passageway 236. Packer element 146 which includes inflatable packer bladder 147 is adjacent the lower portion of the annular inflation fluid passageway 136. Thus, inflation fluid directed into the lower portion 260 of the annular inflation fluid passageway will inflate inflatable packer bladder 147. FIG. 4 shows packer bladder 147 inflated against the side of well bore 2.

After the bladder reaches its maximum or desired inflation pressure, fluid is pumped into the tubing string until the pressure therein exceeds the rupture strength of the rupture disk 164, thereby communicating central flow passage 147 with the well bore 2. Thereafter, a cementitious fluid is pumped through the tubing string into bore 106 of the tail pipe and central flow passage 207. The cementitious fluid then passes through inflation port 232 and circulation port 160 into the well bore. As shown in FIG. 4, cementitious fluid is continually displaced until well bore 2 is filled and the top of the plug 3 is above the top of tail pipe, or in the alternative embodiment, the whipstock mandrel. Preferably, cementitious fluid is continually displaced until the top of the sidetrack plug reaches releasing mechanism 5.

After the sidetrack plug is in place, releasing ball or dart 86 is dropped through the tubing string. The dart is received in seat 80 of releasing sleeve 58. Pressure is increased behind the releasing dart, and shear pins 78 break off so that releasing sleeve 58 is detached from collet 25. Collet fingers 49 then flex inwardly so that collet 25 is disengaged from collet retainer 32. Tubing string 20 can then be removed while the tail pipe remains in the hole thus forming a part of the kickoff plug. In the alternative embodiment, shown in FIG. 2, the identical method is followed, and the whipstock remains in the well bore after the tubing is removed and forms a part of the sidetrack plug.

Figure 6:
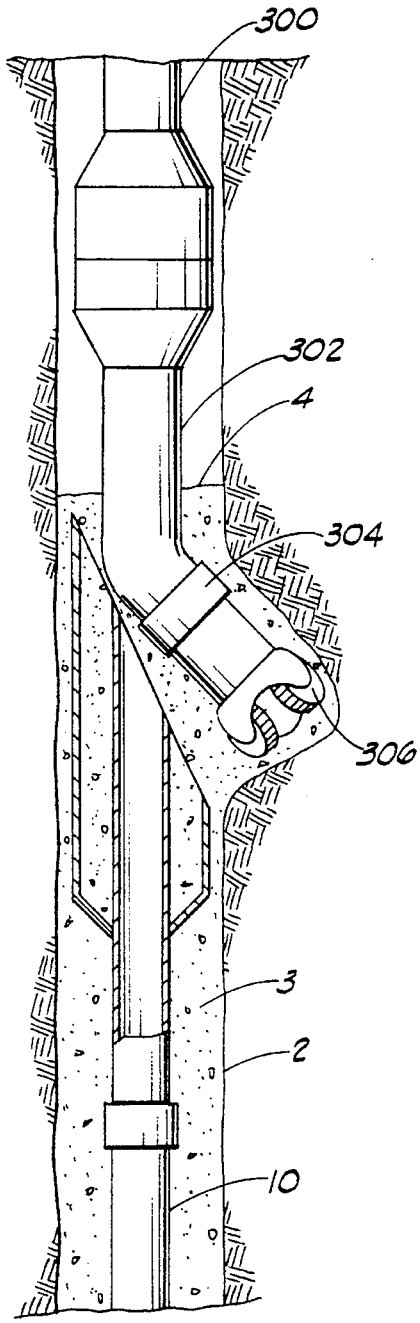
FIG. 6 shows an alternative embodiment of the invention after the plug has been set.

Thus, in the alternative embodiment, the opening dart 255 passes through whipstock bore 109 into central flow passage 207. Once dart 255 seats in opening sleeve 241, flow to packer bladder 147 is established as described herein. Inflation fluid is displaced through whipstock bore 109 into central flow passage 207. Inflation fluid is continually displaced through whipstock bore 109 until, as previously described packer bladder 147 is inflated. Whipstock 108 is thus, operably associated with inflation packer 15, so that the packer is actuated to seal against well bore 2 through whipstock bore 109 anchoring whipstock 108 in the well bore. Once the bladder engages the well bore, cementitious fluid is displaced into the well bore until the whipstock is encased. After the whipstock is in place, drill pipe 300 including a bent sub 302, a motor assembly 304 and a drill bit 306 can be lowered into the well bore. The whipstock ramp will "kick off" or direct the drill bit into the side of well bore 2, as shown in FIG. 6.

Tailpipe 10, inflation packer 15, and in the alternative embodiment, whipstock 108 are constructed of drillable materials so that, if desired, the well bore 2 can be reopened simply by drilling through the sidetrack plug, including the tailpipe, inflation packer and whipstock.

Thus, it is seen that the apparatus and method of the present invention readily achieve the ends and advantages mentioned as well as those inherent therein. While certain preferred embodiments of the invention have been illustrated and described for purposes of the present disclosure, numerous changes may be made by those skilled in the art, which changes are encompassed within the scope and spirit of the present invention as defined by the appended claims.

What is claimed is:

1. An apparatus for setting sidetrack plugs in a well bore comprising:

a tail pipe releasably attached to a tubing string;

an inflation packer assembly attached to said tail pipe, said inflation packer comprising:

a substantially cylindrical packer mandrel having a central flow passage defined therethrough;

a substantially cylindrical packer body disposed about said packer mandrel, said packer body comprising an inflatable packer bladder;

inflation passage means for communicating inflation fluid to said packer bladder, said inflation passage means comprising:

a passageway defined between said packer body and said packer mandrel; and an inflation port disposed through said packer mandrel, so that said central flow passage is communicated with said passageway; and circulation means for communicating said central flow passage with said well bore operably associated with said packer bladder, so that a cementitious fluid pumped through said central flow passage is communicated with said well bore above said packer bladder after said packer bladder reaches a maximum inflation pressure, thereby forming said sidetrack plug; and an inflation port opening sleeve disposed in said packer mandrel and releasably attached thereto, said opening sleeve being operably associated with said inflation port so that said open sleeve initially prevents flow through said inflation port, said sleeve being adapted to release from said mandrel after a predetermined pressure is placed on said sleeve, thereby opening said inflation port and communicating said port with said passageway.

2. The apparatus of claim 1, wherein said circulation means comprises:

a circulation port defined in said packer body in communication with said inflation port, said circulation port being operably associated with said packer bladder whereby said circulation port is closed until said packer bladder reaches a maximum inflation pressure, at which time said circulation port opens, thereby communicating said central flow passage with said well bore.

3. The apparatus of claim 1, wherein said circulation means comprises:

said inflation port;

a circulation port defined in said packer body communicated with said inflation port, said circulation port having a rupture disk received therein operably associated with said packer bladder, so that said rupture disk will rupture after said packer bladder reaches a maximum inflation pressure, thereby communicating said well bore with said central flow passage.

4. The apparatus of claim 1, further comprising:

a whipstock having a whipstock mandrel extending therethrough, said whipstock mandrel having a whipstock bore defined therethrough and having a first end releasably attached to said tubing string and a second end attached to said tail pipe.

5. The apparatus of claim 1, further comprising:

a whipstock;

a whipstock mandrel attached to said whipstock, said whipstock mandrel having a first end releasably attached to said tubing string and a second end attached to said tail pipe, and having a whipstock bore defined therethrough; and releasing means for releasing said whipstock mandrel from said tubing string, whereby said tubing string may be removed from said well bore without removing said whipstock, whipstock mandrel and tail pipe, so that said whipstock, whipstock mandrel and tail pipe form a part of said sidetrack plug.

6. The apparatus of claim 1, further comprising:

releasing means for releasing said tail pipe from said tubing string, whereby said tubing string may be removed from said well bore without removing said tail pipe so that said tail pipe forms a part of said sidetrack plug.

7. An apparatus for setting sidetrack plugs in a well bore comprising:

a tail pipe releasably attached to a tubing string;

an inflation packer assembly attached to said tail pipe, said inflation packer comprising:

a substantially cylindrical packer mandrel having a central flow passage defined therethrough;

a substantially cylindrical packer body disposed about said packer mandrel, said packer body comprising an inflatable packer bladder;

inflation passage means for communicating inflation fluid to said packer bladder, said inflation passage means comprising:

a passageway defined between said packer body and said packer mandrel; and an inflation port disposed through said packer mandrel, so that said central flow passage is communicated with said passageway;

circulation means for communicating said central flow passage with said well bore operably associated with said packer bladder, so that a cementitious fluid pumped through said central flow passage is communicated with said well bore above said packer bladder after said packer bladder reaches a maximum inflation pressure, thereby forming said sidetrack plug; and wherein said circulation means comprises:

said inflation port; and a circulation port defined in said packer body communicated with said inflation port, said circulation port having a rupture disk received therein operably associated with said packer bladder, so that said rupture disk will rupture after said packer bladder reaches a maximum inflation pressure, thereby communicating said well bore with said central flow passage.

8. The apparatus of claim 7, further comprising:

a whipstock having a whipstock mandrel extending therethrough, said whipstock mandrel having a whipstock bore defined therethrough and having a first end releasably attached to said tubing string and a second end attached to said tail pipe.

9. The apparatus of claim 7, further comprising:

a whipstock;

a whipstock mandrel attached to said whipstock, said whipstock mandrel having a first end releasably attached to said tubing string and a second end attached to said tail pipe, and having a whipstock bore defined therethrough; and releasing means for releasing said whipstock mandrel from said tubing string, whereby said tubing string may be removed from said well bore without removing said whipstock, whipstock mandrel and tail pipe, so that said whipstock, whipstock mandrel and tail pipe form a part of said sidetrack plug.

10. The apparatus of claim 7, further comprising:

releasing means for releasing said tail pipe from said tubing string, whereby said tubing string may be removed from said well bore without removing said tail pipe so that said tail pipe forms a part of said sidetrack plug.

11. A bottom hole tool apparatus for setting a sidetrack plug comprising:

a whipstock:

a substantially cylindrical whipstock mandrel extending through said whipstock, said whipstock mandrel having an upper end releasably attached to a tubing string and having a lower end;

a central bore defined through said whipstock mandrel;

an inflation packer connected to said lower end of said whipstock mandrel, said inflation packer having a central flow passage defined therethrough communicated with said central bore of said whipstock mandrel, said inflation packer having an inflatable packer bladder;

inflation passage means for communicating inflation fluid under pressure to said inflatable packer bladder;

circulation means operably associated with said packer bladder for communicating said central flow passage with said well bore, wherein said circulation means communicates said central flow passage with said well bore after said inflatable packer bladder reaches a maximum inflation pressure;

wherein said inflation packer comprises:

a substantially cylindrical outer packer body, said packer body including said inflatable packer bladder;

a substantially cylindrical packer mandrel disposed in said outer packer body, said central flow passage being defined through said packer mandrel, and wherein said inflation passage means comprises:

an inflation fluid passageway defined between said packer mandrel and said outer packer body; and an inflation port defined in said packer mandrel communicating said central flow passage with said inflation fluid passageway; and an inflation port opening sleeve having a central bore defined therethrough disposed in said central flow passage of said packer mandrel and attached thereto, wherein said opening sleeve is initially located to prevent communication between said central flow passage and said inflation port, said opening sleeve being adapted to detach from said mandrel thereby communicating said inflation port and said central flow passage.

12. The apparatus of claim 11, wherein said circulation means comprises:

a circulation port disposed in said packer mandrel communicated with said inflation port.

13. The apparatus of claim 12, further comprising:

a rupture disk received in said circulation port, said rupture disk being operably associated with said packer bladder so that a cementitious fluid pumped through said central bore of said whipstock mandrel and said central flow passage will be communicated with said well bore after said packer bladder reaches a maximum inflation pressure, thereby forming said sidetrack plug.

14. The apparatus of claim 11, further comprising:

a check valve received in said inflation passageway dividing said passageway into an upper portion and a lower portion, wherein said packer bladder is adjacent said lower portion of said inflation passageway, and wherein said check valve allows fluid to flow only in a direction from said upper portion to said lower portion.

15. The apparatus of claim 11, further comprising:

releasing means for releasing said tubing string from said whipstock mandrel, so that said whipstock remains in said well bore after said tubing string is removed, thereby forming a part of said sidetrack plug.

16. The apparatus of claim 11, further comprising:

a fluid diverter sub connected to a lower end of said packer mandrel; and a guide nose connected to said fluid diverter sub.

17. A bottom hole tool apparatus for setting a sidetrack plug comprising:

a whipstock;

a substantially cylindrical whipstock mandrel extending through said whipstock, said whipstock mandrel having an upper end releasably attached to a tubing string and having a lower end;

a central bore defined through said whipstock mandrel;

an inflation packer connected to said lower end of said whipstock mandrel, said inflation packer having a central flow passage defined therethrough communicated with said central bore of said whipstock mandrel, said inflation packer having an inflatable packer bladder;

inflation passage means for communicating inflation fluid under pressure to said inflatable packer bladder;

circulation means operably associated with said packer bladder for communicating said central flow passage with said well bore, wherein said circulation means communicates said central flow passage with said well bore after said inflatable packer bladder reaches a maximum inflation pressure;

wherein said inflation packer comprises:

a substantially cylindrical outer packer body, said packer body including said inflatable packer bladder;

a substantially cylindrical packer mandrel disposed in said outer packer body, said central flow passage being defined through said packer mandrel, and wherein said inflation passage means comprises:

an inflation fluid passageway defined between said packer mandrel and said outer packer body; and an inflation port defined in said packer mandrel communicating said central flow passage with said inflation fluid passageway;

a fluid diverter sub connected to a lower end of said packer mandrel; and a guide nose connected to said fluid diverter sub.

18. The apparatus of claim 17, wherein said circulation means comprises:

a circulation port disposed in said packer mandrel communicated with said inflation port.

19. The apparatus of claim 18, further comprising:

a rupture disk received in said circulation port, said rupture disk being operably associated with said packer bladder so that a cementitious fluid pumped through said central bore of said whipstock mandrel and said central flow passage will be communicated with said well bore after said packer bladder reaches a maximum inflation pressure, thereby forming said sidetrack plug.

20. The apparatus of claim 17, further comprising:

a check valve received in said inflation passageway dividing said passageway into an upper portion and a lower portion, wherein said packer bladder is adjacent said lower portion of said inflation passageway, and wherein said check valve allows fluid to flow only in a direction from said upper portion to said lower portion.

21. The apparatus of claim 17, further comprising:

releasing means for releasing said tubing string from said whipstock mandrel, so that said whipstock remains in said well bore after said tubing string is removed, thereby forming a part of said sidetrack plug.

22. A bottom hole tool apparatus for setting a sidetrack plug comprising:

a whipstock;

a substantially cylindrical whipstock mandrel extending through said whipstock, said whipstock mandrel having an upper end releasably attached to a tubing string and having a lower end;

a central bore defined through said whipstock mandrel;

an inflation packer connected to said lower end of said whipstock mandrel, said inflation packer having a central flow passage defined therethrough communicated with said central bore of said whipstock mandrel, said inflation packer having an inflatable packer bladder;

inflation passage means for communicating inflation fluid under pressure to said inflatable packer bladder; and circulation means operably associated with said packer bladder for communicating said central flow passage with said well bore, wherein said circulation means communicates said central flow passage with said well bore after said inflatable packer bladder reaches a maximum inflation pressure;

wherein said circulation means comprises:

an inflation port disposed in said packer mandrel; and a circulation port disposed in said packer mandrel communicated with said inflation port; and a rupture disk received in said circulation port, said rupture disk being operably associated with said packer bladder so that a cementitious fluid pumped through said central bore of said whipstock mandrel and said central flow passage will be communicated with said well bore after said packer bladder reaches a maximum inflation pressure, thereby forming said sidetrack plug.

23. The apparatus of claim 22, wherein said inflation packer comprises:

a substantially cylindrical outer packer body, said packer body including said inflatable packer bladder;

a substantially cylindrical packer mandrel disposed in said outer packer body, said central flow passage being defined through said packer mandrel, and wherein said inflation passage means comprises:

an inflation fluid passageway defined between said packer mandrel and said outer packer body; and an inflation port defined in said packer mandrel communicating said central flow passage with said inflation fluid passageway.

24. The apparatus of claim 23, further comprising:

an inflation port opening sleeve having a central bore defined therethrough disposed in said central flow passage of said packer mandrel and attached thereto, wherein said opening sleeve is initially located to prevent communication between said central flow passage and said inflation port, said opening sleeve being adapted to detach from said mandrel thereby communicating said inflation port and said central flow passage.

25. The apparatus of claim 23, further comprising:

a check valve received in said inflation passageway dividing said passageway into an upper portion and a lower portion, wherein said packer bladder is adjacent said lower portion of said inflation passageway, and wherein said check valve allows fluid to flow only in a direction from said upper portion to said lower portion.

26. The apparatus of claim 22, further comprising:

releasing means for releasing said tubing string from said whipstock mandrel, so that said whipstock remains in said well bore after said tubing string is removed, thereby forming a part of said sidetrack plug.

27. The apparatus of claim 22, further comprising:

a fluid diverter sub connected to a lower end of said packer mandrel; and a guide nose connected to said fluid diverter sub.

28. A method of setting a kickoff plug in a well bore comprising:

attaching a tail pipe and an inflation packer assembly to a tubing string, said inflation packer assembly comprising:

a packer mandrel having a central flow passage defined therethrough;

a packer body disposed about said packer mandrel, said packer body comprising an inflatable packer bladder;

inflation passage means for communicating inflation fluid to said packer bladder, said inflation passage means including:

a passageway defined between said packer body and said packer mandrel; and an inflation port disposed through said packer mandrel, so that said central flow passage is communicated with said passageway;

circulation means for communicating said central flow passage with said well bore operably associated with said packer bladder, so that a cementitious fluid pumped through said central flow passage is communicated with said well bore above said packer bladder after said packer bladder reaches a maximum inflation pressure, thereby forming said sidetrack plug; and wherein an inflation port opening sleeve is disposed in said packer mandrel and releasably attached thereto, said opening sleeve being operably associated with said inflation port so that said open sleeve initially prevents flow through said inflation port, said sleeve being adapted to release from said mandrel after a predetermined pressure is placed on said sleeve, thereby opening said inflation port and communicating said port with said passageway;

lowering said tubing string into a well bore;

inflating said packer bladder so that it seals against said well bore;

displacing a cementitious fluid into said well bore above said packer bladder; and releasing said tail pipe and said packer assembly from said tubing string after said sidetrack plug is in place.

29. The method of claim 28, further comprising:

locating the desired upper end of said kickoff plug as said tubing string is lowered into said well bore; and circulating fluid through said packer assembly and into said well bore as said tubing string is lowered into said well from said desired upper end of said plug until said packer assembly reaches the desired lower end of said plug.

30. The method of claim 28, wherein said displacing step comprises:

pumping said cementitious fluid through a central bore of said tail pipe and into a central flow passage of said packer assembly after said inflating step; and communicating said central flow passage with said well bore so that said cementitious fluid fills said well bore above said packer bladder.

31. The method of claim 30, further comprising:

repeating said pumping step until said cementitious fluid reaches an upper end of said tailpipe prior to releasing said tubing string, so that said tail pipe forms a part of said kickoff plug.

32. The method of claim 28, further comprising:

connecting a whipstock to said tail pipe, said whipstock having an inclined whipstock ramp and having a whipstock mandrel with a central bore defined therethrough communicated with said central flow passage, wherein said releasing step comprises releasing said whipstock, tail pipe and said inflation packer assembly from said tubing string after said sidetrack plug is in place.

33. The method of claim 32, wherein said displacing step comprises:

pumping said cementitious fluid through said central bore of said whipstock mandrel and said tail pipe into said central flow passage; and communicating said central flow passage with said well bore so that said cementitious fluid fills said well bore above said packer bladder.

34. The method of claim 33, further comprising:

repeating said pumping step until said cementitious fluid reaches an upper end of said whipstock mandrel, so that said whipstock forms a part of said kickoff plug.

35. The method of claim 34, further comprising:

lowering a string of drill pipe into said well bore;

locating said whipstock ramp with said drill pipe; and directing said drill pipe into a side of said well bore with said whipstock ramp.

36. The method of claim 28, further comprising:

a circulation port defined in said packer body communicated with said inflation port, said circulation port having a rupture disk received therein operably associated with said packer bladder, so that said rupture disk will rupture after said packer bladder reaches a maximum inflation pressure, thereby communicating said well bore with said central flow passage.

37. The method of claim 28, further comprising:

a fluid diverter sub connected to a lower end of said packer mandrel; and a guide nose connected to said fluid diverter sub.

* * * * *

UNITED STATES PATENT AND TRADEMARK OFFICE

CERTIFICATE OF CORRECTION

PATENT NO. : 5,566,757

DATED : October 22, 1996

INVENTOR(S) : Robert B. Carpenter; Anthony M. Badalamenti; Jerry L. Logan; David F. Laurel It is certified that error appears in the above-indentified patent and that said Letters Patent is hereby corrected as shown below:

On the front page under the Assignee, after"Halliburton Company, Duncan, Okla." please insert --Atlantic Richfield Company, Plano, Texas--.

Signed and Sealed this

Twenty-seventh Day of January, 1998

*Attest:*

Bruce Lehman

BRUCE LEHMAN

*Attesting Officer*

*Commissioner of Patents and Trademarks*